US006116894A

United States Patent [19]

Kölln et al.

[11] Patent Number: 6,116,894

[45] Date of Patent: Sep. 12, 2000

[54] CONTINUOUS FURNACE

[75] Inventors: Bernd Kölln, Ammerndorf; Henning Richter, Nürnberg, both of Germany

[73] Assignee: Riedhammer GmbH, Nuremberg, Germany

[21] Appl. No.: 08/596,154

[22] PCT Filed: Jun. 9, 1995

[86] PCT No.: PCT/DE95/00778

§ 371 Date: Feb. 12, 1996

§ 102(e) Date: Feb. 12, 1996

[87] PCT Pub. No.: WO95/34793

PCT Pub. Date: Dec. 21, 1995

[30] Foreign Application Priority Data

Jun. 10, 1994 [DE] Germany ..... 44 20 295

[51] Int. Cl.[7] ..... F27B 9/28

[52] U.S. Cl. ..... 432/59; 432/72; 432/152

[58] Field of Search ..... 432/72, 59, 8, 432/152, 144, 145, 176

[56] References Cited

U.S. PATENT DOCUMENTS

| | | | |
|---|---|---|---|
| 2,750,680 | 6/1956 | Houdry et al. | 432/72 |
| 3,437,321 | 4/1969 | Wilkinson | 432/72 |
| 3,606,279 | 9/1971 | Auger | 432/59 |
| 3,787,171 | 1/1974 | Cromp | 432/59 |
| 4,133,636 | 1/1979 | Flynn | 432/72 |
| 4,140,467 | 2/1979 | Ellison et al. | 432/59 |
| 4,503,018 | 3/1985 | Gardner et al. | 432/72 |
| 4,662,840 | 5/1987 | Ellison | 432/59 |

*Primary Examiner*—Denise L. Ferensic
*Assistant Examiner*—Jiping Lu
*Attorney, Agent, or Firm*—John F. A. Earley; John F. A. Earley, III; Harding, Earley, Follmer & Frailey

[57] ABSTRACT

A continuous furnace for baking ceramic molded parts has a heating area (14), a baking area (16) and a cooling area (18). At least one smoke gas duct (22) extends from the heating area (14) into a combustion chamber (24) and at least one hot air duct (28) leads back from the combustion chamber (24) to the heating area (14). Hot air loaded with binder fractions is extracted from the heating area at one or several spots. The combustion gases are then led into a combustion chamber where they are burned, so that a largely purified hot air may then be led back to the heating area.

11 Claims, 1 Drawing Sheet

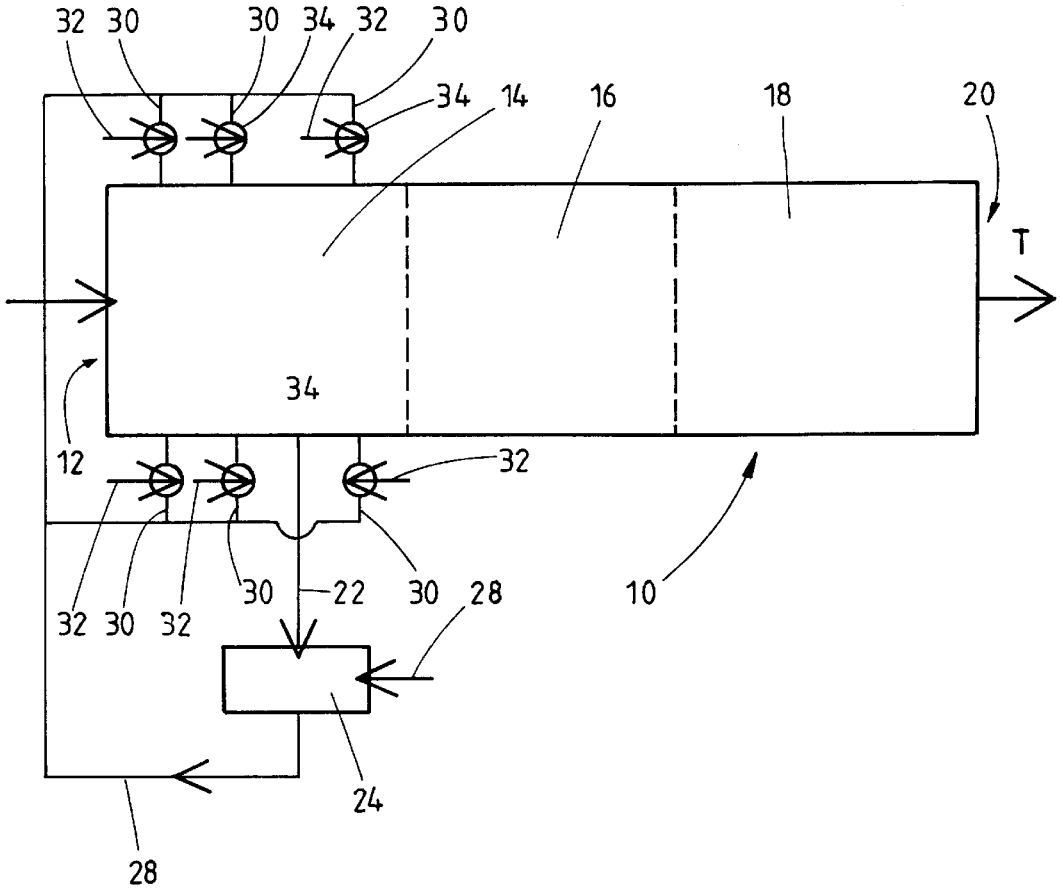
32
30
30
34
32
30
34
14
16
18
20
T
34
12
32
32
30
32
30
22
30
28
10
24
28

CONTINUOUS FURNACE

The present invention pertains to a continuous furnace for baking ceramic molded parts.

The term "continuous furnace" designates all types of continuously operating furnaces, i.e., e.g., tunnel furnaces with furnace carts or roll-over type heating furnaces.

These continuous furnaces are usually designed as follows (viewed in the direction of transportation of the material): Via an inlet, the material to be baked first passes through a heating area, then a baking area, and finally a cooling area before it is removed at the outlet of the furnace.

The term "ceramic molded parts" covers generally all types of ceramic molded parts, such as porcelain, sanitary ceramics, etc. However, it expressly also covers special ceramic products, such as ferrites, e.g., soft ferrites.

Such soft ferrites are characterized in that they are prepared by using a binder/pressing aid and are processed into molded parts. These additives usually comprise organic compounds, such as polyvinyl alcohol.

Compared with prior-art ceramic products, the said soft ferrites are characterized by a special behavior during the baking process. These additives burn out during the heating in the furnace, i.e., in the heating area, so that the furnace atmosphere is loaded with organic components.

Care must therefore be taken to prevent binder vapors from becoming concentrated in the furnace atmosphere in the heating area; on the contrary, uniform atmospheric conditions must always be ensured in order to guarantee a uniformly high product quality.

It was suggested in DE 2 001 148 A that for a uniform heating of the material to be baked, the air of the furnace be led from a tunnel furnace into an intermediate space, that it be fed from there into a combustion chamber, and that it be subsequently led back into the furnace at a different spot.

DE 32 32 294 C1 discloses a process for sintering soft ferrites in a batch furnace, i.e., an intermittently operating furnace, in which the furnace atmosphere is additionally heated outside the furnace chamber during the so-called "binder phase" by continuously burning the binders volatilized during the binder phase in a circulation outside the furnace chamber, and the combustion gases thus formed remain in the circulation, and only the excess amounts of gas are removed.

The gas fed into the furnace chamber shall thus be practically "inert." However, the furnace atmosphere cannot thus be controlled/regulated in the desired manner. In addition, the prior-art process is limited to an intermittently operating furnace.

The basic object of the present invention is to provide a continuous furnace possessing the following features: The components present in the smoke gas of the furnace, which are active in terms of energy, especially the binder components released in the heating area, shall be thermically utilized. Moreover, a defined furnace atmosphere shall be able to be set especially in the heating area. Finally, the pyrotechnical process shall be optimized in terms of energy.

This object is accomplished by a continuous furnace for baking ceramic molded parts having the following features:

The furnace has a heating area, a baking area, and a cooling area, at least one smoke gas duct extends from the heating area into a combustion chamber, at least one hot air duct leads from the combustion chamber back into the heating area, the hot air duct branches in front of the heating area into a plurality of warm air ducts, which open, at spaced locations from one another, into the heating area, cold air ducts open into the hot air duct and/or into the warm air ducts.

Such a continuous furnace offers the following advantages: Hot air, which is loaded with, e.g., gaseous binder components released from the ceramic molded parts during their heating phase, is extracted from the heating area at one or several spots.

The combustion gases are subsequently fed into a combustion chamber and are burned there, so that an extensively purified hot air can be returned into the heating area. The combustion chamber may be arranged in the furnace, but separated from the furnace flue, e.g., under the furnace flue, or on the outside.

The hot air returned has a temperature of, e.g., 600° C. to 1,000° C., i.e., its temperature is markedly higher than the temperature needed in the heating area.

In addition, the temperature in the heating area differs (increases) in the heating area when viewed in the direction of transportation of the material to be baked. However, in this case, the maximum temperature of the furnace atmosphere in the heating area is markedly below the said 1,000° C., namely, e.g., 600° C.

Thus, the feature of feeding cold air into the hot air duct or into the warm air ducts is of particular significance.

The temperature of the air returned into the heating area can be set via the temperature and the amount of the cold air (gas) fed in, on the one hand, and, on the other hand, it is also possible at the same time to influence the type of the desired atmosphere (e.g., the oxygen content in the air fed in) via the cold air.

It was suggested in the state of the art (DE 32 32 294 C1) that practically inert hot air be returned into the furnace. However, this hot air, which originates directly from a combustion, is, as was described, too hot, and, above all, its composition does not correspond to the desired furnace atmosphere.

These shortcomings are avoided by the solution according to the present invention.

Setting a temperature and atmosphere profile adapted to the particular furnace in the heating area is made possible especially by the fact that a plurality of warm air ducts, arranged at spaced locations from one another, are led back into the heating area.

According to one embodiment of the present invention, the warm air ducts are to be arranged one behind the other along the heating area when viewed in the direction of transportation of the material, and warm air is fed in on both sides in order to make the furnace atmosphere uniform. As an alternative or in addition hereto, it would, of course, also be possible to lead a plurality of warm air ducts arranged vertically one on top of another into the heating area in order to ensure a uniform feed of warm air over the height of the furnace flue.

In those cases in which a separate cold air duct is associated with each warm air duct, the temperature and the atmosphere of the returned warm air can be adjusted separately.

According to one embodiment of the present invention, the amount or the temperature of cold air fed in from the cold air ducts can be regulated or controlled, corresponding to a preselectable temperature/atmosphere profile for the continuous furnace.

The regulation or control may be performed, e.g., for a corresponding valve in the junction area of the cold air ducts to the corresponding warm air duct.

The external combustion chamber may be arranged in an appropriate area and is equipped, e.g., with one or more separate burners. Any excess air can be removed via a stack.

The continuous furnace itself may be supplied with energy in the conventional manner, e.g., with gas or by means of electric heating elements.

Based on the described circulation or the afterburning of energy-containing smoke gases; the heating of the heating area may be carried out practically without primary energy, so that burners or electric heating are not absolutely necessary in this area.

Additional features of the present invention appear from the features of the subclaims as well as the other application documents.

The present invention will be explained in greater detail below on the basis of an exemplary embodiment.

Since the basic structure of the continuous furnace according to the present invention, e.g., its refractory lining, may be readily designed according to the state of the art, the only figure shows the principle of a furnace design according to the present invention only schematically.

The reference number 10 designates a tunnel furnace, which has a furnace inlet 12, a heating area 14, a baking area 16, and a cooling area 18, as well as a furnace outlet 20. The path of transportation of the material to be baked, which is led through the furnace 10, is indicated by the arrow T.

A smoke gas duct 22 extends from the heating area into a combustion chamber 24, which is fired with a burner 26.

A hot air duct 28 is led from the combustion chamber 24 back in the direction of the heating area 14. However, before entering the heating area 14, the hot air duct 28 branches into six partial ducts (called warm air ducts) here, which are designated by the reference number 30. The warm air ducts 30 open in pairs from left and right into the furnace flue through the furnace wall and are arranged one behind the other in the direction of transportation T on each side of the furnace.

One cold air duct 32 leads to each warm air duct 30, and one control valve 34 each is arranged in the transition area, so that the amount of the cold air fed in can be set. It is, of course, also possible to individually set the temperature of the cold air fed into the individual warm air ducts 30.

It is thus possible not only to ensure that warm air having a preselectable temperature will be fed to a particular spot of the furnace along the heating area 14 (viewed in the direction of transportation T), but at the same time also to regulate or control, e.g., the oxygen content in the air thus fed in via the amount of cold air. This is important precisely in the case of the baking of special ceramic materials, such as soft ferrites, which are extremely susceptible to variations in the atmosphere.

To also achieve the most uniform possible feed of warm air over the height of the furnace flue, it is, of course, also possible to arrange a plurality of warm air ducts 30 one on top of another at individual spots.

What is claimed is:

1. Continuous furnace for firing ceramic molded parts, comprising:

a furnace wall defining a tunnel through which ceramic parts to be fired are moved, a pre-heating zone (14), a firing zone (16), and a cooling zone (18), at least one combustion gas duct (22) extending from said preheating zone (14) into a combustion chamber (24), at least one hot air duct (28) leading back from said combustion chamber (24) to said pre-heating zone (14).

said hot air duct (28) branching into a plurality of warm air ducts (30) before entering said pre-heating zone said warm air ducts (30) entering said pre-heating zone (14) at different locations in the furnace wall from one another, and cold air ducts (32) opening into at least one of said hot air duct (28) and said warm air ducts (30), in which a separate cold air duct (32) is associated with each of said warm air ducts (30).

2. Continuous furnace in accordance with claim 1, in which the amount of cold air fed in from the said cold air ducts (32) can be regulated or controlled.

3. Continuous furnace in accordance with claim 2, in which a regulation or control valve (34) is arranged in the junction area of said cold air ducts (32) to said respective warm air ducts (30).

4. Continuous furnace in accordance with claim 1, in which said combustion chamber (24) is provided with burners (26).

5. Continuous furnace in accordance with claim 1, in which said pre-heating zone (14) is free from burners or electric heating means.

6. Continuous furnace in accordance with claim 1, in which said warm air ducts (30) open into both opposing side walls of the furnace.

7. Continuous furnace in accordance with claim 1, in which said warm air ducts (30) are arranged one behind the other when viewed in the direction of transportation (T) of the ceramic molded parts.

8. Continuous furnace in accordance with claim 1, in which said warm air ducts (30) open into said pre-heating zone (14) at different distances from the bottom of the furnace.

9. Continuous furnace in accordance with claim 1, in which the combustion chamber is arranged under the bottom of the furnace flue.

10. Continuous furnace for firing ceramic molded parts, comprising a pre-heating zone (14), a firing zone (16), a cooling zone (18), and a furnace channel extending through said furnace, at least one combustion gas duct (22) extending from the pre-heating zone (14) into a combustion chamber (24), at least one hot air duct (28) leading back from the combustion chamber (24) to the pre-heating zone (14), the hot air duct (28) branching into a plurality of warm air ducts (30) before entering the pre-heating zone, said warm air ducts opening into the pre-heating zone (14) at spaced locations from one another, and cold air ducts (32) opening into the hot air duct (28) and/or into at least one of the warm air ducts (30), in which a separate cold air duct (32) is associated with each of said warm air ducts (30).

11. Continuous furnace for firing ceramic molded parts, comprising a pre-heating zone (14), a firing zone (16), a cooling zone (18), and a furnace channel extending through said furnace, at least one combustion gas duct (22) extending from the pre-heating zone (14) into a combustion chamber (24), at least one hot air duct (28) leading back from the combustion chamber (24) to the pre-heating zone (14), the hot air duct (28) branching into a plurality of warm air ducts (30) before entering the pre-heating zone, said warm air ducts opening into the pre-heating zone (14) at spaced locations from one another, and cold air ducts (32) opening into the hot air duct (28) and/or into at least one of the warm air ducts (30), in which a separate cold air duct (32) is associated with each warm air duct (30), in which a regulation or control valve (34) is arranged in the junction area of the cold air ducts (32) to the respective warm air ducts (30) for regulating or controlling cold air fed in from the cold air ducts (32), in which the combustion chamber (24) is provided with burners (26), in which the pre-heating zone (14) is free from burners or electric heating means, in which the warm air ducts (30) open into both opposing side walls of the furnace, in which the warm air ducts (30) are arranged one behind the other when viewed in the direction of transportation (T) of the ceramic molded parts, in which the warm air ducts (30) open into the pre-heating zone (14) at different distances from the bottom of the furnace, and in which the combustion chamber is arranged under the bottom of the furnace channel.

* * * * *